United States Patent [19]

Patel et al.

[11] 4,089,252

[45] May 16, 1978

[54] PROPORTIONAL FORCE AMPLIFIER

[75] Inventors: Kishor J. Patel, Hales Corners; Allen J. Carlson, Milwaukee, both of Wis.

[73] Assignee: Applied Power, Inc., Milwaukee, Wis.

[21] Appl. No.: 761,193

[22] Filed: Jan. 21, 1977

[51] Int. Cl.[2] ..... F15B 15/17; F15B 9/10

[52] U.S. Cl. ..... 91/49; 91/376 R; 91/416; 91/431; 92/114

[58] Field of Search ..... 91/49, 416, 431, 376 R, 91/417 R

[56] References Cited

U.S. PATENT DOCUMENTS

| | | | |
|---|---|---|---|
| 1,585,529 | 5/1926 | Boving | 91/416 |
| 3,343,459 | 9/1967 | Jacobsen | 91/416 |
| 3,757,640 | 9/1973 | Karol | 91/49 |

FOREIGN PATENT DOCUMENTS

| | | | |
|---|---|---|---|
| 1,133,061 | 11/1956 | France | 91/49 |

*Primary Examiner*—Paul E. Maslousky

*Attorney, Agent, or Firm*—John J. Byrne; Edward E. Dyson

[57] ABSTRACT

An apparatus for causing a low force input movement from a control rod to cause a corresponding movement in an output member by force amplification through hydraulic pressure. A piston is provided that has a greater pressure area on one side than on its other side. Orifice means are provided between a pressure chamber and a control chamber and between the control chamber and the reservoir such that as said second orifice means is varied, the piston will move until a null position is reached.

9 Claims, 4 Drawing Figures

PROPORTIONAL FORCE AMPLIFIER

A principal objective of this invention is to provide an apparatus where proportional displacement from a low force input control member causes an output member to accurately follow the movements of the control member.

Another principal objective of this invention is to provide an apparatus that provides the aforementioned displacement with an hydraulic force amplification wherein a low input effort generates a high force output.

Another important objective of this invention is to provide a device of the type described wherein the elements thereof can be manufactured with relatively low manufacturing tolerances without a corresponding decrease in efficiency.

A still further objective of this invention is to provide a proportional force amplifier wherein a hydraulic pressure will convert a relatively low input effort to a high force output but which provides means for manual operation if there is a lack of hydraulic pressure.

Another important objective of this invention is to provide a proportional force amplifier wherein the input control rod and the output rod are maintained in a hydraulically balanced or null condition until the input control rod is displaced in one direction or the other. Upon displacement of the input rod a hydraulic imbalance is caused and means are provided to cause a corresponding movement in the output element until a new balance or null position is obtained.

Another important objective of this invention is to provide a device of the type described wherein a piston divides a cylinder into chambers wherein a control pressure is established which is approximately one-half of the supply pressure. This one-half supply pressure acts on a control pressure side of a piston which is double the pressurized side. Due to this area and pressure balance, the output piston rod is maintained in a force balance. This position is called the "null" of the apparatus. A change in the null creates a pressure imbalance and causes the output rod to be displaced. An imbalance will be created upon movement of the input rod. Movement in the output rod will take place until a displacement relationship achieves the null or force balance once again.

Another and still further objective of this invention is to provide a device of the type described including a novel construction for insuring a manual capability of the elements in the event of a hydraulic power failure.

It is another objective of this invention to provide a highly compact and rugged hydraulic servo system, for accomplishing the aforementioned objectives.

These and other objectives of the invention will become more apparent to those skilled in the art by reference to the following detailed description when viewed in light of the accompanying drawings wherein.

Figure 1:
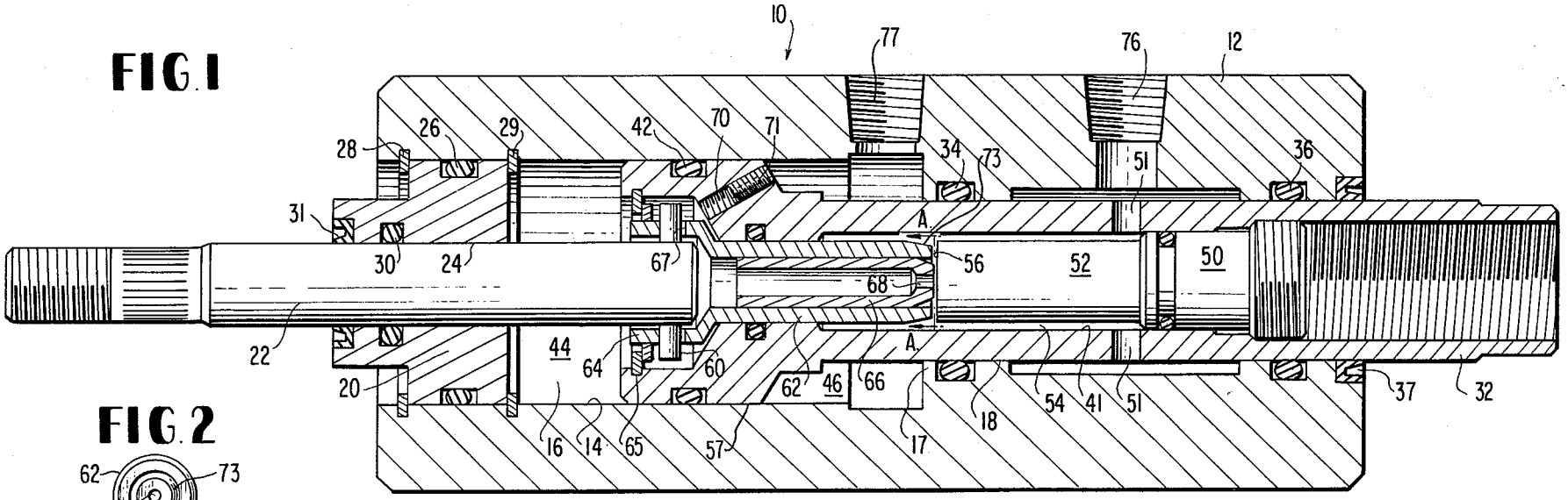
FIG. 1 is a longitudinal cross-sectional view of the apparatus of this invention.
Figure 2:
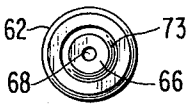
FIG. 2 is a partial cross-section along the line A—A of FIG. 1.

Referring now to the drawings, a proportional force amplifier is generally shown by the numeral 10. The force amplifier is comprised generally of a cylinder housing 12 having an interior working bore 14. The bore 14 is divided into a first chamber 16 and a second chamber 18 having a smaller effective area. The chambers have an annular ledge 17 therebetween. The bore 14 is enclosed by a gland 20 through which an input displacement rod 22 is slidably received through a central aperture 24. A seal 26 is provided to seal the outer surface of the gland with the inner surface of housing 12. The gland is secured into position by snap rings 28 and 29. A seal 30 and a wiper seal 31 are provided between the input displacement rod 22 and the aperture 24.

Extending into chamber 18 at the other end of housing 12 is an output displacement rod 32. Rod 32 is slidably received within the housing and is sealed at 34 and 36 and by wiper seal 37. The output rod 32 which, together with seal 42, divides the working chamber into pressure control chamber 44 and a pressure chamber 46. The output rod 32 is hollow throughout its length as indicated by the numeral 41. A plug member 50 is inserted into rod 32. Extending inwardly from plug 50 is a plug extension 52 having a slightly lesser diameter than the hollow cavity 41 and thereby forming an annular chamber 54. The plug extension is terminated by a planar surface 56 transverse to the axis of housing 12. The cavity 54 is enlarged (beyond ledge 17) to receive the enlarged inner end 57 of output rod 32. This enlarged inner end 57 receives the inner end of the input displacement rod 22.

A pin 60 is carried by input displacement rod 22. An adapter sleeve 62 has an enlarged head 64 and a narrow stem extending into rod 32. The head 64 has radial openings 67 to receive the outer ends of the pin 60. The openings 67 are greater than the circumference of the pins whereby movement can take place therebetween. This reduces the level of tolerances required in this assembly. Fitted within the adapter 62 is a nozzle-forming sleeve 66. The sleeve 66 is terminated by an orifice 68 disposed adjacent planar surface 56. The enlarged inner or piston end of rod 32 is indicated by the numeral 57.

An orifice 70 through the piston 57 connects the pressure chamber 46 with the control chamber 44. A plug member 71 is inserted therein to vary this orifice as required. The piston 57 and control rod 32 are dimensioned so the surface area on the pressure chamber side 46 is approximately one-half of that on the pressure control chamber side 44.

Chamber 46 is subjected to supply pressure from pressure port 77, and chamber 44 is subjected to the control pressure. The flow of fluid is from pressure chamber 46 through orifice 70 into the control pressure chamber 44. From control pressure chamber 44 fluid flows through adapter 62 and out nozzle 68. A resistance or pressure drop is developed between the surface 56 and the nozzle 68. The fluid exiting from this area flows through chamber 54, out the holes 51 and returns to tank via the outlet port 76. The input and output displacement rods 22 and 32 will remain stationary as long as the orifice means 70 and nozzle 68 in cooperation with the surface 56 develop equal pressure drops compensating for the different size work areas in the chambers 46 and 44 of the output rod 32.

In the event input rod 22 is moved to the right as shown in FIG. 1, the nozzle 68 will approach the surface 56 which causes a decrease in flow at that point and an increase in pressure in control chamber 44. This upsets the balance condition and will cause the piston, and thus the output displacement rod 32, to move to the right until the space between the nozzle 68 and the surface 56 again develops a "null" or equalization of pressure drop with that through orifice 70.

In order to preserve the characteristics of nozzle 68, the outer edge of adapter 62 is tapered at 73 and the sleeve 66 extends beyond the tapered area. The extension over the taper protects the orifice when the rod 22 pushes the adapter 62 against the surface 56. The cross-sectional area of rod 22 is made slightly greater than the cross-sectional area acting against the adapter. This is to account for cross-sectional area loss because of nozzle opening 68.

Figure 4:
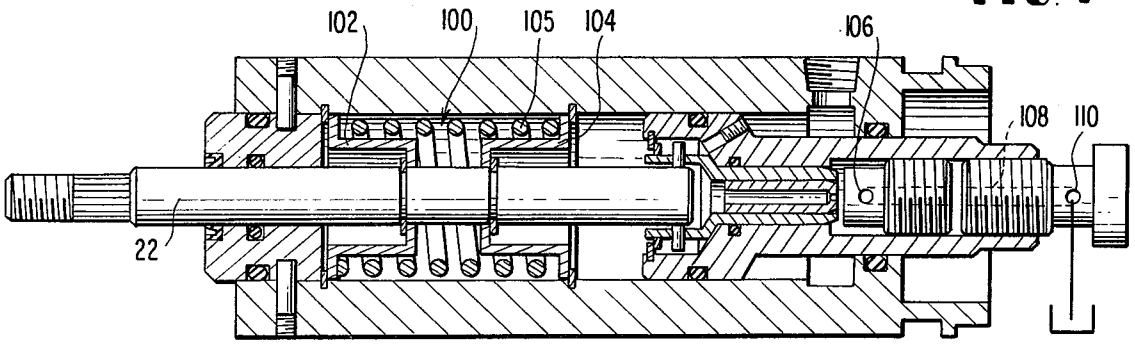
FIG. 4 is an embodiment of the invention in cross-section.

In FIG. 4 there is shown an embodiment having a spring centering assembly 100 about the input shaft 22. The assembly is comprised of a pair of hat-shaped spring clips 102 and 104 having a compression spring located therebetween. The embodiment is for use with equipment where an automatic return to center is important. Note that in the FIG. 4 embodiment the route to tank is through an opening 106, channel 108 and bore 110.

Figure 3:
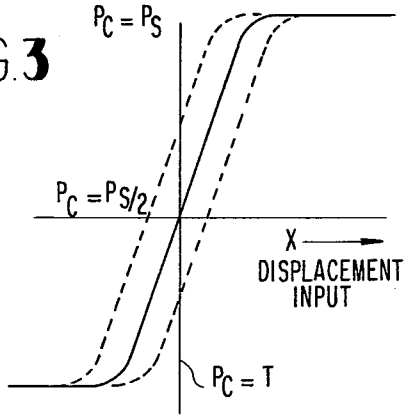
FIG. 3 is a graph showing the pressure gain curve for the pilot stage.

FIG. 3 is a graph showing the pressure gain curve for the pilot stage.

In a general manner, while there has been disclosed an effective and efficient embodiment of the invention, it should be well understood that the invention is not limited to such an embodiment as there might be changes made in the arrangement, disposition, and form of the parts without departing from the principle of the present invention as comprehended within the scope of the accompanying claims.

We claim:

1. A proportional force amplifier comprising:

(a) a housing having a working chamber therethrough, a pressure port, and a tank port leading to said working chamber;

(b) a hollow output displacement rod slidably received in one end of said housing and having an outer surface;

(c) a plug member disposed in said output rod intermediate the length of said rod;

(d) a seal between the outer surface of said displacement rod and the wall of said working chamber between said pressure and tank ports;

(e) a piston at an inner end of said output rod dividing said work chamber into a control chamber and a pressure chamber, the latter being in communication with said pressure port;

(f) an input displacement rod extending into said control chamber;

(g) a hollow adapter extending into said output rod, said adapter having a nozzle juxtaposed near said plug member;

(h) means affixing said adapter to said input rod for longitudinal movement therewith;

(i) first orifice means extending through said piston and providing communication between said pressure chamber and said control chamber; and (j) second orifice means between said control chamber and said tank port defined by a spacing between said adapter and said plug member to effect a null position when said second orifice means develops an equal force on either side of said piston.

2. The invention of claim 1 wherein said affixing means is a pin carried by said input displacement rod and a pair of holes formed in said adapter for receiving said pin.

3. The invention of claim 2 wherein the cross-sectional area of each of said holes is greater than the cross-sectional area of said pin.

4. The invention of claim 1 wherein spring-centering means are located about said input displacement rod.

5. The invention of claim 1 wherein said first orifice means includes a plug member.

6. The invention of claim 1 wherein communication means to said tank port is through said output displacement rod.

7. The invention of claim 1 wherein an outer edge of said adapter adjacent to the nozzle therein is tapered away from the nozzle.

8. The invention of claim 7 wherein said adapter comprises a radially outer member and a radially inner member, and the inner member extends axially inwardly beyond the outer member.

9. A proportional force amplifier comprising, a housing having an elongated working chamber therethrough extending from an input end to an output end, a controlling rod extending into said chamber and having an inner end intermediate said input and output ends, an output displacement rod extending into said chamber through said output end, a pressure port extending through said housing, a reservoir port spaced from said pressure port and extending through said housing, a piston formed on an inner end of said output displacement rod and dividing a first portion of said chamber into a pressure chamber and a control chamber, said output displacement rod having an elongated cavity defined by a bottom and a cylindrical side wall, a seal about said side wall separating said reservoir port from said pressure port, a hollow adapter having an inlet and an outlet, said adapter being connected to said inner end of said controlling rod and slidably received in said cavity and communicating said control chamber with said reservoir port through a pressure drop area between the outlet of said adapter and said bottom, said piston formed with an orifice communicating said pressure port with said control chamber such that a fluid flows from said pressure port through said orifice into said control chamber, from said control chamber through the inlet of said adapter into said adapter, through said adapter and the restrictive area between said adapter and said bottom and to the reservoir port, whereby when said input rod moves inwardly, said adapter outlet approaches said bottom and flow is restricted to the reservoir port thereby increasing pressure in said control chamber and causing said piston to move away from said adapter until the space between said bottom and said adapter reaches a null.

* * * * *

UNITED STATES PATENT OFFICE

CERTIFICATE OF CORRECTION

Patent No. 4,089,252 Dated May 16, 1978

Inventor(s) Kishor J. Patel et al.

It is certified that error appears in the above-identified patent and that said Letters Patent are hereby corrected as shown below:

Figure 1 of the drawing figures and the drawing figure which appears on the cover sheet should be deleted to appear as per attachment.

Column 3, lines 5-7 should read "In order to preserve the characteristics of nozzle 68, the outer edge of nozzle-forming sleeve 66 is tapered at 73 and the adapter sleeve 62 extends beyond the tapered area. The exten-".

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*

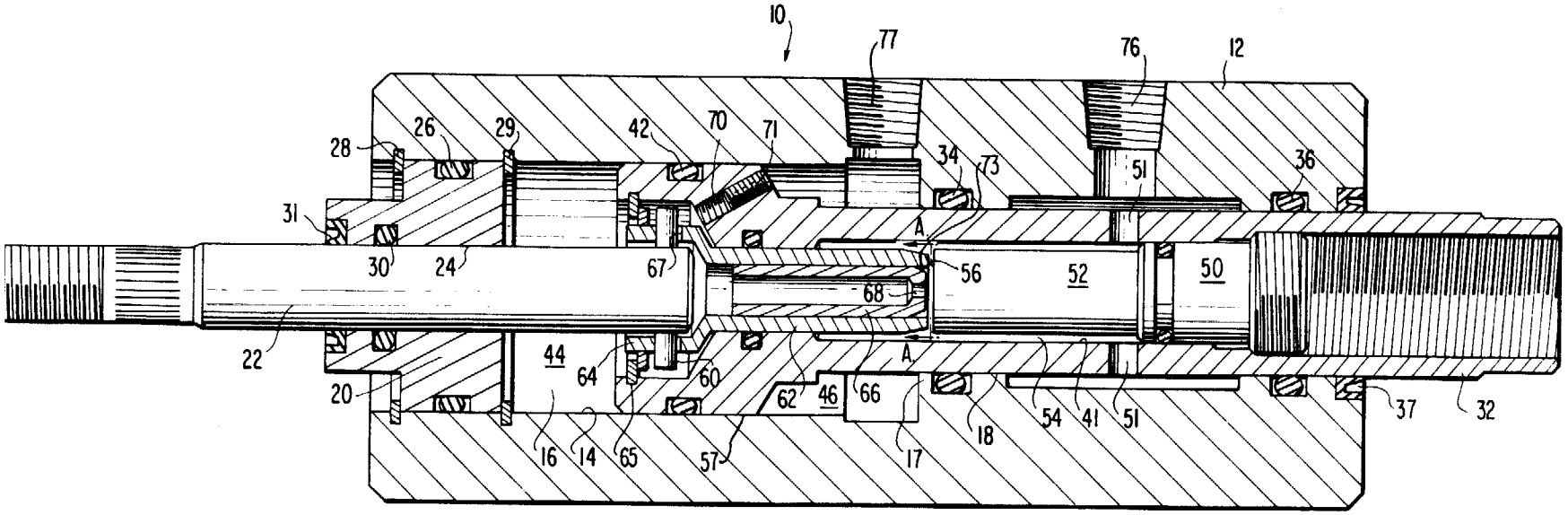
10
12
14
16
17
18
20
22
24
26
28
29
30
31
32
34
36
37
41
42
44
46
50
51
52
54
56
57
60
62
64
65
66
67
68
70
71
73
76
77
A
A